United States Patent [19]

Goessler et al.

[11] Patent Number: 4,794,233

[45] Date of Patent: Dec. 27, 1988

[54] RADIANT HEATER

[75] Inventors: Gerhard Goessler, Oberderdingen; Eugen Wilde, Knittlingen, both of Fed. Rep. of Germany

[73] Assignee: E.G.O. Elektro-Geräte Blanc u. Fischer, Fed. Rep. of Germany

[21] Appl. No.: 98,495

[22] Filed: Sep. 18, 1987

[30] Foreign Application Priority Data

Oct. 17, 1986 [DE] Fed. Rep. of Germany ..... 3635345

[51] Int. Cl.[4] ..... H05B 3/74

[52] U.S. Cl. ..... 219/464; 219/453; 219/460; 219/506

[58] Field of Search ..... 219/464, 453, 458, 459, 219/460, 506; 362/92

[56] References Cited

U.S. PATENT DOCUMENTS

| | | | |
|---|---|---|---|
| 2,165,003 | 7/1939 | Peters | 219/453 |
| 2,346,237 | 4/1944 | Rutenber | 219/453 |
| 2,492,100 | 12/1949 | Kitson | 219/453 |
| 2,659,069 | 11/1953 | Kinsella | 219/453 |
| 2,735,924 | 2/1956 | Shaw | 219/453 |
| 2,870,316 | 1/1959 | Ferguson | 219/453 |
| 3,067,315 | 12/1962 | Hurko | 219/464 |
| 3,375,346 | 3/1968 | Gaugler | 219/449 |

FOREIGN PATENT DOCUMENTS

| | | | |
|---|---|---|---|
| 3317100 | 11/1984 | Fed. Rep. of Germany . | |
| 3501365 | 7/1986 | Fed. Rep. of Germany . | |
| 987723 | 8/1951 | France . | |
| 1346574 | 2/1974 | United Kingdom | 219/464 |
| 1406028 | 9/1975 | United Kingdom | 219/461 |
| 2083327 | 3/1982 | United Kingdom | 219/459 |

*Primary Examiner*—E. A. Goldberg
*Assistant Examiner*—Teresa J. Walberg
*Attorney, Agent, or Firm*—Steele, Gould & Fried

[57] ABSTRACT

A radiant heater has a shallow shell-like support for carrying heating resistors and a glass ceramic top plate. A connection and hot warning indicating device is arranged in the space between the top plate and the support. The light source is preferably a low voltage tungsten halogen lamp which projects, at most, slightly beyond the front side of the support. Despite a very compact construction, the radiant heater is not subject to dazzle effects even over a large area, and a readily visible indicating illumination is obtained. The light source can be operated at different brightness levels, for example one brightness level indicating the switched-on condition of the heating resistor and the other brightness level indicating the hot-to-touch condition of the top plate, notwithstanding the switched-on or switched-off condition of the heating resistor.

45 Claims, 2 Drawing Sheets

RADIANT HEATER

BACKGROUND OF THE INVENTION

The invention relates to a radiant heater for placing on the inside of an in particular glass ceramic top plate, with a support for at least one elongated heating resistor substantially located in a plane located roughly parallel to the top plate on a front side facing the latter and in particular a substantially exposed heater coil and with an electric light source connected as an additional indicating device and located in the vicinity of the support.

British Pat. No. 13 46 574 discloses a radiant heater, in which the indicating light source formed by an electric lamp or bulb is positioned relatively deeply below the plane of the heating resistor, so that the radiant heater has a very considerable overall height. Another disadvantage of this known construction is that the illuminating effect brought about by the light source and therefore the indicating effect obtained is relatively weak, which in particular with high ambient brightness means that the indicated position cannot even be recognised if a relatively expensive reflector is used for the light source. A further disadvantage of the known construction is that it is difficult to obtain access to the bulb for replacement purposes, so that when said bulb fails for the first time, it is scarcely possible to replace it, so that the indicating device is out of operation for the remainder of the cooker life.

SUMMARY OF THE INVENTION

The object of the invention is to provide a radiant heater of the aforementioned type which, in the case of simple and compact construction, permits a clearly visible indication on the part of the indicating device.

In the case of a radiant heater of the aforementioned type, this object is achieved by arranging at least one light source to extend approximately into the area of the plane of the heating resistor. The light source can be located substantially completely within the space surrounded by a flat outer tray or dish of the support and the top plate and at a distance from the top plate which is less than its width, i.e. it is for example immediately adjacent to the inside of the top plate, so that essentially the full illuminating power of the light source is available for indication purposes.

The inventive construction makes it possible to so arrange the light source that only indirect light is visible in the indicating display or translucent top plate and there is no glare or dazzle from the bulb. For example the side of the light source facing the top plate, e.g. the top of the associated lamp envelope can be provided with an optionally dome-shaped cover, which e.g. slipped onto the same, or with a reflecting coating. The cover can be made translucent in the manner of a light filter, so that the area of the top plate facing it is illuminated and does not appear as an unilluminated, e.g. dark zone. Appropriately the light source is arranged in such way that it uninterruptedly transilluminates the top plate in the area of the entire field bounded by the inner circumference of the support.

The inventive construction is particularly suitable for those radiant heaters, in which the heater coils comprise substantially bare, exposed resistance wire, e.g. formed from a chromium, iron and aluminium alloy. It is conceivable to form at least one connectable heater circuit by a high temperature radiator, such as a quartz envelope-encapsulated heating lamp. Such radiant heaters with one, two or more circuits, particularly if their heater circuits are exclusively formed by bare, exposed heater coils, are very simple to manufacture, have a high operating reliability and also a long life. However, the heater coils only glow a certain time after switching on and there are considerable time differences here as a function of the heater construction, the cross-section of the resistance wire and its specific loading. However, there is a need to be able to recognise the one position of such radiant heaters immediately after switching on and the inventive indicating device is suitable for this purpose. Instead of this or in addition thereto, the inventive lindicating device is e.g. also suitable for indicating the hot state of the cooking field for so long after switching off to enable the top plate to cool sufficiently to ensure that contact is no longer dangerous. Other than for hot plates, which are in this case formed by the top plate, the inventive radiant heater is also suitable for other heating systems, e.g. for the heating of a baking oven and in this case the top plate at least partly forms an oven wall, e.g. the upper, or as underheating, the lower oven wall.

BRIEF DESCRIPTION OF THE DRAWINGS

These and further features of preferred further developments of the invention can be gathered from the description and drawings and the individual features can be realised in any embodiment of the invention and in other fields, either singly or in the form of subcombinations. Embodiments of the invention are now described relative to the drawings, wherein.

DETAILED DESCRIPTION OF THE PREFERRED EMBODIMENTS

Figure 1:
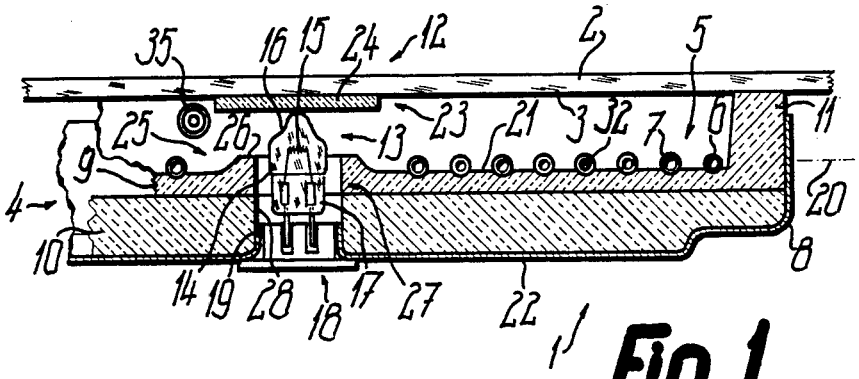
FIG. 1 is a detail of an inventive radiant heater in cross-section.

As is shown in FIG. 1, a radiant heater 1 which is round, circular of polyangular and axially symmetrical to a central axis is associated with a translucent glass ceramic top plate 2. Top plate 2 can have a size corresponding to that of the radiant heater 1 and can form with the latter a closed constructional unit, or it can be significantly larger than the radiant heater, so that it can e.g. be used for forming two or more separate cooking fields or which are combinable to different cooking field sizes with two or more jointly and/or separately connectable radiant heaters 1 arranged on its inside 3 and which in juxtaposed manner are then pressed against the inside 3 of cover plate 2, whose rim is e.g. received in a support frame.

The shallow tray or shell-like radiant heater 1, whose overall height is e.g. only at the most a quarter and in particular roughly a sixth of its width, has a shallow tray-like support 4 for an electric heater, namely a heating resistor 5. The elongated heating resistor 5, laid in at least one spiral form is formed by one, two or more heater coils 6, 7, which are individually or jointly connected in as a function of the desired power.

The main supporting part, which constitutes an externally robust casing for the support 4 is an external support shell 8 made from sheet metal or the like, whose rim extends with limited spacing up to the inside of the top plate 2, but which can also be constructed substantially rimless as a simple base plate. In the support shell 8 or on the bottom is provided a relatively thick, electrically insulating layer based on pyrogenic silica as thermal insulation 10 and it extends up to the rim of support shell 8. On the planar front side of said thermal insulation 10 facing top plate 2 is provided an insulator 9 constructed as a moulding and its planar back surface engages in a substantially whole-area manner, which is essentially made from ceramic fibres and is e.g. produced by moulding. On its outer circumference support tray 8 also has a rim 11 made from insulating material, e.g. moulded from ceramic fibres and which projects over the heating resistor 5 against top plate 2 and which in the represented embodiment is constructed in one piece with insulator 9 and engages on the inner circumference or the rim of support shell 8. The face of rim 11 is pressed in a substantially whole-area manner against the inside 3 of top plate 2 and defines the associated cooking field with its inner circumference.

Radiant heater 1 is provided with an indicating device 12, which has as its indicating member a light source 13. Light source 13 can admittedly have the same rated voltage as the heating resistor 5, but is appropriately formed by a weak current lamp of 6 or 12 V, because the latter can be very compactly constructed. A particularly high illuminating power in the case of great robustness is obtained if the light source 13 has at least one miniature tungsten-halogen lamp or bulb 14, whose central axis is appropriately roughly at right angles to top plate 4 and is preferably at least approximately located in the central axis of radiant heater 1. In a closed, transparent envelope 16, bulb 14 has a filament 15 positioned transversely to its central axis and is provided at it rear end with a width-reduced pinched base 17 of envelope 16. Through said pinched base 17, connecting lugs of the filament 15 run parallel to one another and to the central axis towards the outside, the outer parts of the connecting lugs form plug-in lugs for the electrical connection of light source 13. The total length of envelope 16 and therefore the actual lamp or bulb body is only slightly greater than double the length of the pinched base 17, as well as only slightly, e.g. approximately one third larger than the maximum width of envelope 16, which at its front end passes out into a central, stud-like protuberance, the so called pump connection. The total length of envelope 16 is roughly of the same order or magnitude as the thickness of support 4 in the vicinity of the heating resistors.

For the easily replaceable reception of the light source 13 or the bulb is provided a socket 18 located in its central axis and which has bushes for receiving the plug-in lugs of the bulb. Socket 18 is inserted in amount of support 4 so a to be easily removable towards the back of the latter and is essentially formed by a bush-like collar 19, which is shaped from the bottom of the support shell 8 and engages in the insulating part of support 4, namely in thermal insulation 10.

Heating resistor 5 or heater coils 6, 7 are located substantially in a common, central plane 20 at right angles to the central axis of radiant heater 1 only slightly displaced with respect to top plate 2 relative to the planar front side 21 of insulator 9 located in the vicinity of heating resistor 5, because heater coils 6, 7 by e.g. partial embedding of longitudinal portions in insulator 9 are fixed to support 4 and are secured in position. Light source 13 or the bulb extends both towards top plate 2 and towards the back 22 of support 4 on either side and over and beyond said plane 20, which passes through the envelope 16 forming the cavity for filament in such that the latter is slightly displaced in the direction of top plate 2 with respect to plane 20. Thus, filament 15 is located between the plane 20 or front side 21 and the inside 3 of top plate 2, but is closer to the front side 21 of insulator 9. Thus, part of envelope 16 is within insulator 9, whilst the pinched base 17 is completely within the insulating part of support 4, e.g. in such a way that the parting plane between insulator 9 and thermal insulation 10 passes approximately through the centre of the length of pinched base 17. The electrical connection of light source 13 is also substantially located within support 4 or within the insulating part thereof and in the represented embodiment is located in thermal insulation 10. By means of a collar projecting over its outer circumference, socket 18 engages on the back 22 of support 4 or the support shell 8, so that socket 18 only projects over back 22 by the extremely limited thickness of said collar. However, it is also conceivable for socket 18 to be completely located within the thickness of support 4, i.e. it does not project over its back 22.

In order that it is not possible to see the light source 13 and at least filament 15 from the outside from any possible viewing angle, which could lead to dazzle, between light source 13 and top plate 2 is provided a cover 23, which in the represented embodiment is formed by a planar and e.g. circular cover plate 24, which is thinner than top plate 2. Cover plate 24 is either uniform over its entire surface or becomes increasingly permeable to light or translucent from its centre towards the outside, so that top plate 2 is also transilluminated by light source 13 in the vicinity thereof. Cover 23 is preferably separated by a gap from the inside 3 or top plate 2, but could also engage in small or whole-area manner with said inside 3. Correspondingly cover 23 can also be contact-free with respect to the light source 13 or envelope 16, but it is also possible for light source 13 or envelope 16 to extend virtually up to contact with its pump connection on cover 23. Thus, in exceptional cases and without using any adhesive or other additional fastening means, it can be held in substantially clearance-free manner between light source 13 and top plate 2. Appropriately cover 23 is made from an at least slightly compression elastic material, so that it can optionally be held with a certain elastic tension. In a very simple, thermally stable construction cover 23 is made from an e.g. ceramic fibre-containing insulating material, in particular from the same material as moulding 9, i.e. cover 23 can be made by moulding and subsequent drying.

Through a planned reduction of the thickness of the shield or cover 23, it is possible to modify the permeability to light over the entire surface or in the manner of patterns, so that also watermark-like symbols or the like can be provided.

In order that the light from light source 13 is favourably and e.g. uniformly distributed over the associated cooking field of top plate 2, a light guide means 25 is provided, which can be substantially exclusively formed by shaping the moulding 9, whose surface at least slightly reflects and optionally the associated surface of cover 23. As shown in FIG. 1, moulding 9 has a protuberance 26 surrounding in annular manner light source 13 and projecting slightly over front side 21. The outer circumference of said said protuberance passes in cross-section in concavely curved manner into front side 21, the face of said protuberance 26 being located in a plane, which is only very slightly set back with respect to filament 15. The light guide means 25 is appropriately designed in such a way that the light is mainly directed onto the outer rim 11 surrounding heating resistor 5.

In order that the bulb forming the light source 13 is not exposed to excessively high thermal loads, it can be appropriate to provide a cooling means 27 for light source 13. This cooling means is in particular provided for a relatively temperature-sensitive pinched base 17 and is so constructed that said based 17 is not heated above the permitted temperature for the bulb of approximately 350° C. It is admittedly conceivable to make the through-hole for the light source 13 in the insulating parts of support 4 in such a way that the light sources or envelope 16, or at least over part of the length thereof and especially in the vicinity of a linear ring zone is surrounded in approximately contacting manner by the insulating material of at least one of the insulating parts. This ring zone could in particular be provided on the end of the through-hole facing top plate 2 and therefore in the vicinity of envelope 16 very close to filament 15, so that the part of envelope 16 behind it is virtually sealed with respect to the space receiving the heating resistor 5. However, the through-hole is preferable constituted by a shaft 28 which is wider than the bulb, so that with respect to the insulating parts the bulb is located in substantially contact-free manner in the e.g. cylindrical shaft 28, which is coaxial thereto and whose width is e.g. half as large again as the greatest width of envelope 16 and as wide as the outer circumference of collar 19, so that the latter can engage in shaft 28. If the socket 18 is permeable to air in the longitudinal direction of the through-hole, e.g. as a result of interruptions, then at least a slight air circulation can occur in shaft 28 and this contributes to an adequate cooling of the bulb. The metal collar 19 engaging in the through-hole also contributes to the cooling, the amount varying as a function of the diameter and length, because it can pass on the heat absorbed in the through-hole relatively rapidly to the outside into the large-area support shell bottom which is well shielded by the insulating parts against direct heating. Collar 19 can for this purpose be provided with surface-enlarging heat exchange profiles, e.g. inwardly projecting ribs, so that its absorption capacity is increased. Socket 80 is appropriately made from a ceramic material, e.g. steatite.

Figure 2:
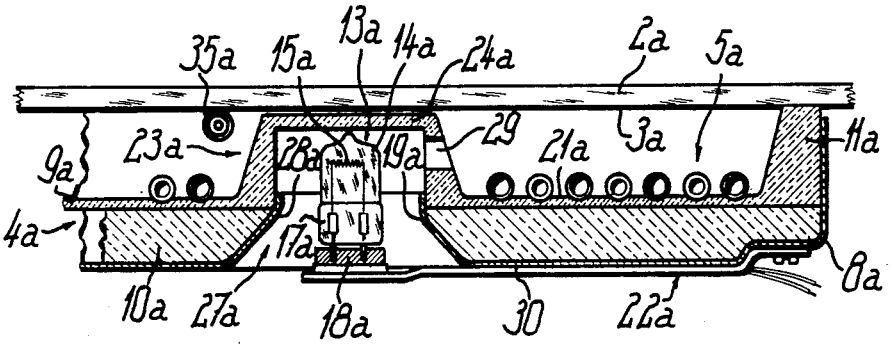
FIG. 2 is another embodiment in a representation corresponding to FIG. 1.

For corresponding parts in FIG. 2, the same reference as in FIG. 1 are used, followed by a. Whereas in the embodiment according to FIG. 1 between cover 23 and insulator 9 or protuberance 26, there is a circumferentially uninterrupted, annular light passage slot for the light from the light source 13, cover **23*a* according to FIG. 2 has a jacket annularly surrounding in spaced manner the light source 13*a* or bulb, said jacket appropriately starting from the front side 21*a* of insulator 9 and is preferably constructed in one piece therewith from the same material. This jacket whose thickness increases downwards by a frustum-shaped construction of its outer circumference is provided with light passage openings 29 located roughly parallel to top plate 2*a* and extending over at least part of its length. Although it would be conceivable to only have a single light passage opening, there are appropriately several such openings uniformly distributed over the entire circumference. The light passage openings 29 are appropriately located roughly in the plane of filament 15*a*. Cover plate 24*a* is constructed in one piece with the covering jacket, so that cover 23*a* is engaged in cup or dome-shaped manner over light source 13*a*. Compared with top plate 2*a*, cover 23*a* has a smaller spacing and is consequently contact-free. In special cases cover 23*a* could be used for impact damaging of top plate 2*a* in the vicinity of the associated field zone, particularly the central field zone of the associated cooking field and therefore for protecting top plate 2*a*** against damage by impact stresses.

Cooling means **27*a* according to FIG. 2 has a funnel or frustum-shaped widened shaft 28*a* towards the back 22*a* of support 4*a*, the funnel-shaped widening extending approximately over the entire thickness of thermal insulation 10*a* and therefore substantially over the entire length of the pinched base 17*a*. The funnel-shaped widening is bounded by the collar 19*a*, which extends with a cylindrical end collar into the inner circumference of insulator 9*a* or the jacket of cover 23*a*** and engages on said inner circumference. The taper angle of the funnel-shaped widening can e.g. be approximately 90°.

In the embodiment according to FIG. 2 socket **18*a* is not provided directly on support shell 8*a* and is instead located on a separate support part 30, which extends into the vicinity of shaft 28*a* and is easily detachably fixed, e.g. by a screw to support shell 8*a* close to the outer circumference of support 4*a*. Thus, support part 30 and with it light source 13*a* can be easily removed from the area of the outer circumference of support 4*a* and taken away as an entity, so that then it is very easily possible to change the bulb. Support part 30 is e.g. formed by a sheet metal strip, which can have a bent outer end, which engages in a corresponding peripheral shoulder offset with respect to top plate 2*a* compared with the remaining base of support shell 8*a* and is fixed to said peripheral shoulder by a screw or the like. On the other end of the sheet metal strip freely projecting in the manner of a cantilever from its fixing point and resiliently engaging on back 22*a* of support shell 8*a* is fixed the socket 18*a*. It is also conceivable for bulb replacement purposes to so resiliently downwardly bend support part 30, that the bulb is freed from shaft 28*a*, after which support part 30** can be swung outwards about its fixing screw by e.g. 180°.

Figure 3:
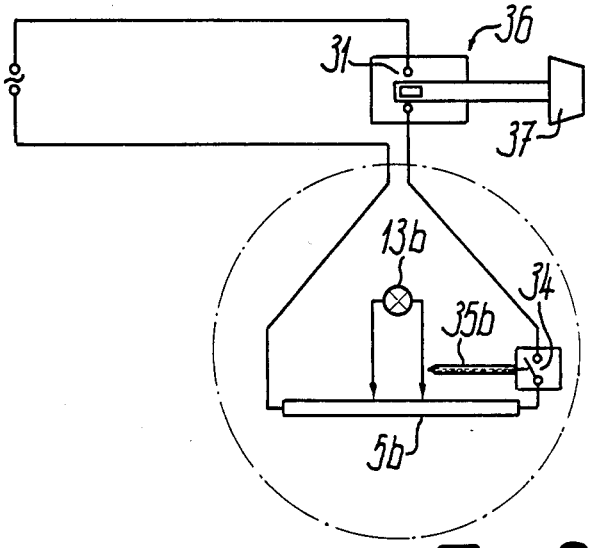
FIG. 3 is a first embodiment for the circuit of the indicating device.

As shown in FIG. 3, light source **13*b* can be directly switched with the switching contacts 31 for heating resistor 5*b*, so that there is no need for a separate contact for operating the indicating device. If the rated voltage of light source 13*b* is lower than that of heating resistor 5*b*, the latter can be used in potentiometer-like manner as a voltage tap for light source 13*b*. The voltage tap, i.e. the connection of the two lines for the light source appropriately does not take place directly to the particular heater coil and according to FIG. 1 occurs on a connecting pin 32, which is either provided at the end of one or between the ends of two series-connected heater coils or in the connecting region of said coils. It is advantageously fitted in such a way that it engages in a portion of the heater coil, in which a plurality of the turns thereof are closely juxtaposed and to which the connecting pin 32 is so fixed e.g. by a bent end portion by spot welding or the like, that said end portion engages in the inner circumference of the coil shape. Connecting pin 32 can at least partly pass through the insulating parts of support 4, the associated lead to the socket 18 being fixed to its end. Thus, said lead can also be laid within the support 4**.

As is also shown in FIGS. 1 to 3, with radiant heater 1 or 1*a* or 1*b* is associated a further, independent, temperature-dependent or cycle-functioning switching contact 34, which is arranged between the manually operated contact 31 and heating resistor 5*b* in a lead. Switching contact 34, which is e.g. associated with a temperature monitor or an over heating protection means, is controlled by a heat sensor 35 or 35*a* or 35*b*, which can be constructed as a rod-like expansion sensor arranged directly on the casing of switching contact 34. Such an expansion sensor e.g. has two telescopically arranged rods with different expansion coefficients, namely an outer tube fixed on the casing of switching contact 34 and an inner rod supported by its outer end axially on the outer tube in the vicinity of its free end and whose other end projecting into the casing of switching contact 34 acts directly on a pressure point of the switching contact constructed as a snap-action switch. Thermal sensor 35 or 35*a* or 35*b* is, as shown in FIG. 1 and 2, arranged in the vicinity of the centre of heating resistor 5 or the cooking field between the front side 21 of support 4 and the inside 3 of top plate 2, so as to be contact-free with respect thereto or all parts and parallel to the top plate. It is positioned directly adjacent to the outer circumference of cover 23 or 23*a* and is nearer to top plate 2 than to the front side 21 of support 4, it being substantially tangential to a circle placed round the central axis of radiant heater 1 or 1*a* and the diameter thereof is of the same order of magnitude as the diameter of the smallest spiral turn of heating resistor 5 or 5*a* or is smaller than the latter and is slightly larger than the diameter of cover 23 or 23*a*. In the case of the construction according to FIG. 1, thermal sensor 35 is located in the vicinity of one side of an annular light exit slot. Thermal sensor 35 passes through the rim 11 of insulator 9, as well as the rim of support shell 8 of support 4 and the switch housing or switching head of the temperature-dependent-operating switching contact 34 is located directly on the outside of the rim or is mounted thereon. In the case of a connection of light source 13*b* according to FIG. 3, said light source 13*b* is switched on and off with the working cycle of switch contact 34. However, it is also conceivable to connect the lead of light source 13*b* associated with switching contact 34 to the lead between switching contacts 31, 34, or its other lead to the unconnected mains connection and in the first case switching contact 34 is ineffective. The important advantage of the aforementioned connection possibilities is the extremely short connecting lines integrated entirely into the radiant heater as components of the associated assembly.

The switching contact 31 according to FIG. 3 is e.g. part of electrical operating means 36 for radiant heater 1*b* constructed as on-off switches or as multi-timing switches. Said operating means 36 can e.g. be manually operated by means of an operating knob 37 located at one end of a switching shaft. In the construction according to FIG. 4 the operating means 36*c* can, instead of a power control device or a timing switch, be a temperature regulator, whose switching contact 31*c* for heating resistor 5*c* is switched on and off as a function of the desired temperature set with the knob 37*c* by means of a temperature-dependent sensor system, particularly a hydraulic expansion system. This sensor system e.g. has a tubular thermal sensor 38 arranged in the heating region of heating resistor 5*c* and filled with an expansion fluid. Sensor 38 is connected by means of a capillary line 39 to an expansion member 40, e.g. a pressure element of operating means 36, which acts on switching contact 31*c*. Operating means 36 also has a signal contact 41, which is constructed as an on-off switch and is closed other then in the "zero" position of the switching shaft. This signal contact 41 is located in one of the two leads to light source 13*c*.

In addition to the desired construction or in place thereof, light source 13*c* can also be controlled by means of a hot warning contact 42, which is appropriately associated in parallel arrangement with the same lead as signal contact 41. The hot warning contact 42 preferably controlled by the same thermal sensor as switching contact 34 and formed by a further contact of the same switching head, is so controlled by the associated thermal sensor that it only opens below a predetermined radiant heater temperature and is closed above it. If signal contact 41 is opened by the disconnection of the still hot radiant heater, the hot warning contact 42 remains closed up to the predetermined cooling of the radiant heater or the associated cooking field of top plate 2*a* and light source 13*c*, despite the signal contact 41 being open, is still connected to power and is illuminated. Only on dropping below the predetermined temperature does the hot warning contact 42 open and then the light source 13*c* goes out. In order to permit a distinction as to whether light source 13*c* indicates the switched on state of heating resistor 15*c* or merely the hot state of the cooking field, different voltages are supplied by the two leads associated on the one hand with signal contact 41 and on the other with the hot warning contact 42 and in particular a lower voltage is supplied via the lead of contact 42. Thus, for distinction purposes, light source 13*c* is on the one hand more brightly illuminated and on the other hand less brightly illuminated. A diode 43 can be connected in the associated lead as a voltage reducer.

Figure 4:
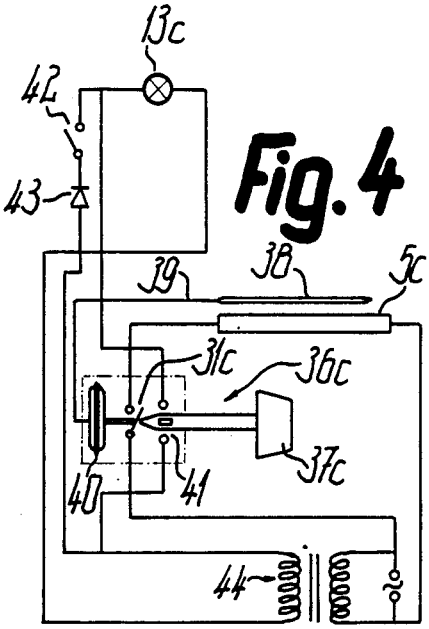
FIG. 4 is another embodiment for the circuit of the indicating device.

In the embodiment according to FIG. 4 a voltage supply separate from the heating resistor 5*c* is provided for light source 13*c* and is in the low voltage range of e.g. 6 or 12 V and is connected to the mains by means of a suitable voltage reducer. The latter can be constituted by a transformer 44, a phase lag control or capacitors can be used as series resistors.

Figure 5:
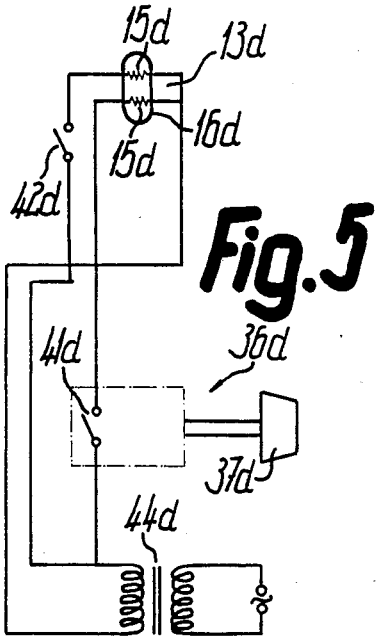
FIG. 5 is another embodiment of the indicating device with associated circuit.

As shown in FIG. 5, signal contact 41*d* and hot warning contact 42*d* can also switch separate light sources or bulbs or separate filaments 15*d* arranged in the manner of a two-filament lamp in a common envelope 16*d*. In the case of each of these constructions, the possibility exists of very good distinction between the hot warning contact and the on position of the heating resistor.

In the case of the construction according to FIG. 2 the circumferential rim of cover 23*a*, optionally without separate light openings, can be made so thin-walled that it is adequately translucent to ensure a good illumination of the heating field. If light passage openings are provided, they can assist as vent holes for the lamp area.

What is claimed is:

1. A radiant heater adapted for use inside of an electric cooker having a top plate, said heater comprising:

a support having an insulator member, the insulator member having a front side facing the top plate, said insulator member being made from an insulating material;

at least one elongated heating resistor located substantially in a plane substantially parallel to the top plate, said heating resistor being located on the front side of said insulator member; and, an electric light source electrically connected as an indicating device separate from the heating resistor, said light source being located in the vicinity of the insulator member, wherein the electric light source is arranged to extend substantially into the vicinity of the front side of the insulator member and of the plane of the heating resistor.

2. A radiant heater according to claim 1, wherein the front side of the insulator member defines a front plane, the light source projecting to at least said front side.

3. A radiant heater according to claim 2, wherein the light source projects to one side over the front plane of the insulator member, said light source penetrating said front side of the insulator member, said front side and said heating resistor being spaced from the top plate.

4. A radiant heater according to claim 1, wherein said light source has at least one filament translucently encapsulated, said at least one filament of the light source being located between said front side of the insulator member and the top plate.

5. A radiant heater according to claim 4, wherein said at least one filament is located nearer to the front side of the insulator member than to the top plate.

6. A radiant heater according to claim 1, wherein said light source has an external width, and further comprising a light absorbing cover between the light source and the top plate, said light absorbing cover being larger than the external width of the light source.

7. A radiant heater according to claim 6, wherein said light absorbing cover extends in contact-free manner close to the inside of the top plate.

8. A radiant heater according to claim 6, wherein the light source has a translucent bulb body, said light absorbing cover extending in contact-free manner close to the bulb body of the light source.

9. A radiant heater according to claim 6, wherein said light absorbing cover is at least partly plate-like and at most substantially as thick as the top plate.

10. A radiant heater according to claim 6, wherein the light absorbing cover has a rim at least partly surrounding the light source.

11. A radiant heater according to claim 10, wherein said rim is dome-shaped.

12. A radiant heater according to claim 6, wherein said light absorbing cover has at least one opening defining a light passage.

13. A radiant heater according to claim 12, wherein said light absorbing cover has a rim and said at least one light passage is provided in said rim.

14. A radiant heater according to claim 6, wherein said light absorbing cover is constructed from an insulating material.

15. A radiant heater according to claim 14, wherein said light absorbing cover is constructed from a ceramic fiber containing insulating material.

16. A radiant heater according to claim 1, wherein the light source is formed by a low-tension current lamp.

17. A radiant heater according to claim 1, wherein the light source is formed by a tungsten-halogen bulb.

18. A radiant heater according to claim 1, wherein the light source is a bulb arranged at right angles to the top plate.

19. A radiant heater according to claim 1, wherein the light source is a bulb with a base adapted for insertion in a socket, and at most projecting slightly over a back side of the support.

20. A radiant heater according to claim 1, further comprising means for cooling the light source.

21. A radiant heater according to claim 20, wherein said cooling means has at least one ventilation shaft.

22. A radiant heater according to claim 21, wherein said ventilation shaft defines an inner wall surrounding the light source and spaced therefrom.

23. A radiant heater according to claim 21, wherein said ventilation shaft extends through said insulator member.

24. A radiant heater according to claim 21, wherein said ventilation shaft has a wider crossed-section at the back side of the insulator member.

25. A radiant heater according to claim 1, further comprising light guiding means for the light source.

26. A radiant heater according to claim 25, wherein the light guiding means is constructed for light guidance substantially circumferentially around the light source and substantially parallel to the top plate.

27. A radiant heater according to claim 25, wherein the light guiding means is constructed for light guidance substantially against an inner circumference of a support rim at least substantially extending up to the top plate and surrounding the heating resistor, said insulator member and said top plate together enveloping a heated space.

28. A radiant heater according to claim 27 wherein the support rim is formed by a profiled section of the insulator member.

29. A radiant heater according to claim 1, wherein the light source is directly electrically connected to switching contacts provided for switching the heating resistor.

30. A radiant heater according to claim 1 wherein the light source is electrically connected in parallel with the heating resistor.

31. A radiant heater according to claim 1, wherein the light source is electrically connected by at least one voltage tap provided in potentiometer-like manner directly on the heating resistor.

32. A radiant heater according to claim 1, wherein the light source is switched by means of at least on independent contact separate from switching contacts provided for switching the heating resistor.

33. A radiant heater according to claim 32 wherein said independent contact is a signal contact operated by a switch-on device for the heating resistor.

34. A radiant heater according to claim 32, further comprising a hot warning contact operated by a temperature sensor, said independent contact forming said hot warning contact.

35. A radiant heater according to claim 1, further comprising means for operating the light source in at least two different lighted switch positions.

36. A radiant heater according to claim 35 wherein the different switch positions for the light source define different brightness levels.

37. A radiant heater according to claim 35, wherein in one of said different switch positions the light source is switched via the heating resistor and in an other one of said different switch positions the light source is switched via the hot warning contact arranged in a line parallel to the signal contact.

38. A radiant heater according to claim 35, wherein in one switch position the light source has a lower brightness of the same filament controlled by means of a voltage reduction member than in the other switch position.

39. A radiant heater according to claim 38, wherein the filament has a lower brightness when switched via the hot warning contact.

40. A radiant heater according to claim 35, wherein at least two switch positions are associated with separate filaments.

41. A radiant heater according to claim 40, comprising a multifilament lamp wherein the separate filaments are arranged in a common bulb body.

42. A radiant heater according to claim 1, wherein said heating resistor is at least one substantially exposed heater coil.

43. A radiant heater according to claim 1, wherein said top plate is made from glass ceramic material.

44. A radiant heater adapted for use inside of an electric cooker having a top plate, said heater comprising:

a support with an insulator member, the insulator member having a front side facing the top plate and being made from an insulating material;

at least one elongated heating resistor located substantially in a plane substantially parallel to the top plate, said heating resistor being mounted on the front side of said insulator member;

an electric light source electrically connected as an indicating device separate from the heating resistor said light source being located in the vicinity of the insulator member; and, a cover for the electric light source, said cover being constructed from the same insulating material as the insulator member of the support.

45. A radiant heater according to claim 44 wherein said cover is made integrally with the insulator member.

* * * * *

UNITED STATES PATENT AND TRADEMARK OFFICE

CERTIFICATE OF CORRECTION

PATENT NO. : 4,794,233

DATED : December 27, 1988

INVENTOR(S) : Gerhard Goessler, et al.

It is certified that error appears in the above-identified patent and that said Letters Patent is hereby corrected as shown below:

Column 2, line 9, delete "one" and insert --on--.

Signed and Sealed this

Seventeenth Day of October, 1989

*Attest:*

DONALD J. QUIGG

*Attesting Officer*

*Commissioner of Patents and Trademarks*